US007137789B2

(12) United States Patent
Apostolides et al.

(10) Patent No.: US 7,137,789 B2
(45) **Date of Patent: *Nov. 21, 2006**

(54) VENT FOR REDUCING SEAL PRESSURE IN PUMP ASSEMBLY

(75) Inventors: John K. Apostolides, Pittsburgh, PA (US); Ronald S. Lusco, Clayville, PA (US); John J. McCosby, Washington, PA (US)

(73) Assignee: RPM Industries, Inc., Washington, PA (US)

( * ) Notice: Subject to any disclaimer, the term of this patent is extended or adjusted under 35 U.S.C. 154(b) by 215 days.

This patent is subject to a terminal disclaimer.

(21) Appl. No.: 10/408,596

(22) Filed: Apr. 7, 2003

(65) Prior Publication Data

US 2003/0202887 A1 Oct. 30, 2003

Related U.S. Application Data

(63) Continuation-in-part of application No. 09/670,706, filed on Sep. 27, 2000, now Pat. No. 6,544,008, which is a continuation-in-part of application No. 08/896,779, filed on Jul. 18, 1997, now Pat. No. 6,461,118.

(51) Int. Cl.
*F04B 17/00* (2006.01)

(52) U.S. Cl. ..... 417/310; 417/440; 418/104; 418/206.1

(58) Field of Classification Search ..... 417/310, 417/440, 234; 418/104, 206.1
See application file for complete search history.

(56) References Cited

U.S. PATENT DOCUMENTS

| | | | | |
|---|---|---|---|---|
| 3,146,720 | A * | 9/1964 | Henry | 417/310 |
| 4,561,297 | A * | 12/1985 | Holland | 73/119 A |
| 4,813,853 | A * | 3/1989 | Otto et al. | 417/295 |
| 5,244,367 | A * | 9/1993 | Aslin | 418/104 |
| 5,419,686 | A * | 5/1995 | Wissmann et al. | 417/380 |
| 5,482,441 | A * | 1/1996 | Permar | 417/216 |
| 6,123,531 | A | 9/2000 | Blume et al. | |

FOREIGN PATENT DOCUMENTS

| | | |
|---|---|---|
| DE | 41 25 128 A1 | 2/1992 |
| EP | 0 785 361 A1 | 7/1997 |
| GB | 2 172 339 A | 9/1986 |

* cited by examiner

*Primary Examiner*—Anthony D. Stashick
*Assistant Examiner*—Ryan P. Gillan
(74) *Attorney, Agent, or Firm*—Cohen & Grigsby, P.C.

(57) ABSTRACT

An engine pump is provided which operates with an internal combustion engine or as a supplemental pump or as used in a stand alone device, and includes an internal vent for improved pump and motor durability. The pump is operably and sealably connected to a motor and adapted for connection with a source of fluid and a discharge means. An internal vent is positioned in between an armature shaft of bore along an inlet port thereby decreasing the pressure in the area of the seal. Alternatively, a valve is positioned between the inlet and outlet ports to selectively permit fluid pumped between the inlet and outlet ports to pass through when the outlet port is flow restricted.

20 Claims, 6 Drawing Sheets

VENT FOR REDUCING SEAL PRESSURE IN PUMP ASSEMBLY

CROSS REFERENCE

This application is a continuation-in-part application of U.S. application Ser. No. 09/670,706 filed on Sep. 27, 2000 now U.S. Pat. No. 6,544,008, entitled "Internal Vent for Reducing Seal Pressure in Prelubrication Pump Assembly;" which is a continuation-in-part of U.S. application Ser. No. 08/896,779, now U.S. Pat. No. 6,461,118 which issued on Oct. 8, 2002, filed on Jul. 18, 1997, entitled "Improved Pump Assembly."

FIELD OF THE INVENTION

The present invention relates to an improved pump which operates with an internal combustion engine or as a supplemental pump on-board a vehicle or apparatus, or as stand alone or hand-held device; and, in particular, to a pump that includes an internal vent for improved pump and motor durability.

BACKGROUND OF THE INVENTION

Generally, the fluid pump of the present invention is an improvement over pumps shown U.S. Pat. Nos. 4,553,512, 4,875,551 and 4,502,431. These pumps are used to lubricate the engine prior to the initial phase of the cranking of the starter motor to turn over an engine. Typically, oil is used as a lubricant to allow engine parts to slide freely and easily with reduced friction. Notwithstanding the use of lubricants having high lubricity there continues to be abrasive wear between metal parts in internal engine components such as the turbocharger, camshaft, crank shaft and rocker assembly, for example. It has been known for some time that the greatest wear on internal engine parts is at the commencement of ignition cranking and engine start-up. During that time, there is insufficient oil pressure in the engine to provide lubrication to the various parts throughout the engine. Accordingly, for these initial moments during start-up, there is metal rubbing against metal without a sufficient lubricant interface so that deterioration in the internal engine components takes place over time.

A particularly important solution to this problem was provided by a prelubrication system disclosed in U.S. Pat. No. 4,502,431 in which oil is introduced in the engine prior to cranking and start-up. The starter motor is utilized as the means for powering the pump to provide prelubrication. In that system, the starter motor armature shaft is connected to the pump's pumping gears which are rotated to provide the pumping action to the engine to prelubricate prior to the starter motor's solenoid engaging the starter to crank the engine for start-up. One particular embodiment of the starter motor and pump combination is disclosed in U.S. Pat. No. 4,553,512 which is incorporated herein by reference.

The present invention provides a similar pump assembly as that disclosed in U.S. Pat. No. 4,553,512 to provide a selectable means for either prelubricating the engine or pumping the oil out for a quick efficient oil change. This is particularly useful to large fleet operators of vehicles which require frequent oil changes.

Accordingly, it is an object in an embodiment of the present invention to provide a pump mechanism to pump oil out of an engine sump without having to open the sump's oil plug. It is a further object in an embodiment of the invention to provide a seal bore vent to the pump inlet to minimize the oil pressure at the seal during all modes of operation. Another embodiment of the invention is to provide a supplemental pump on-board for evacuating and/or refilling multiple reservoirs, or in a hand-held device that may be used for multiple reservoir evacuation and/or refill. It is a further object in an embodiment of the invention to provide a prelube pump having a valve which is selectively operable in the prelubrication mode as well as an oil exchange mode from the engine compartment.

SUMMARY OF THE INVENTION

Generally, the present invention provides a pump used in a pump assembly to evacuate or refill an engine or other machine based reservoir and that contains an internal vent or passageway to release pressure from the inlet port or suction side to the pump seal bore. The vent comprises a grove, hole, drilling or the like that is capable of reducing pressure at the seal.

In an embodiment of the invention, a pump is integrated into the starter motor or an internal combustion engine of a vehicle. In another embodiment, an AC or DC electric gear pump technology, hydraulically actuated or air actuated gear pump motor assembly is used. The base portion of the pump generally comprises the back or bearing end of the starter motor or motor assembly and includes a sealed opening through which an extended armature shaft can be mounted to rotate or power the pump gears. A pump housing is integrally formed on the base plate which provides a cavity in which the pump gears are mounted and includes an inlet and outlet port. A seal bore vent is provided to the pump inlet which uses a passageway from the pump inlet into the armature shaft or pump seal bore to minimize the oil pressure at the seal during all modes of operation. This vent relieves pressure from the seal which seals the pump cavity from the motor cavity. By minimizing or eliminating excess pressure, the pump and motor are further protected from damage and their longevity enhanced. This is especially the case when a valve selector and port are provided in the pump as set forth in one of the embodiments hereof.

The pump also functions as a supplemental pump and can be mounted on-board and used for evacuation and/or refilling of any or multiple compartments. For instance, it can be used in any pump assembly to evacuate and/or refill an engine or other machine based reservoir such as hydraulics, transmission or differential reservoirs. It can also be employed off-board or with hand-held pumps for evacuating and/or refilling one or multiple compartments. In a hand-held embodiment, a pump is used as a hand-held or stand alone pump in line with a portable flexible conduit used to transfer fluid.

Additionally, in an embodiment the invention includes an additional port for operation of a valve mechanism to permit the oil to be pumped and bypassed to the outlet port in normal operation. By rendering the valve "ineffective," oil can be pumped to the outlet port for either prelubrication or for changing the oil or other fluid of the vehicle.

Other advantages of the present invention will become apparent from a perusal of the following description of a presently preferred embodiment taken in connection with the accompanying drawings.

DESCRIPTION OF EXAMPLES OF THE INVENTION

Figure 1:
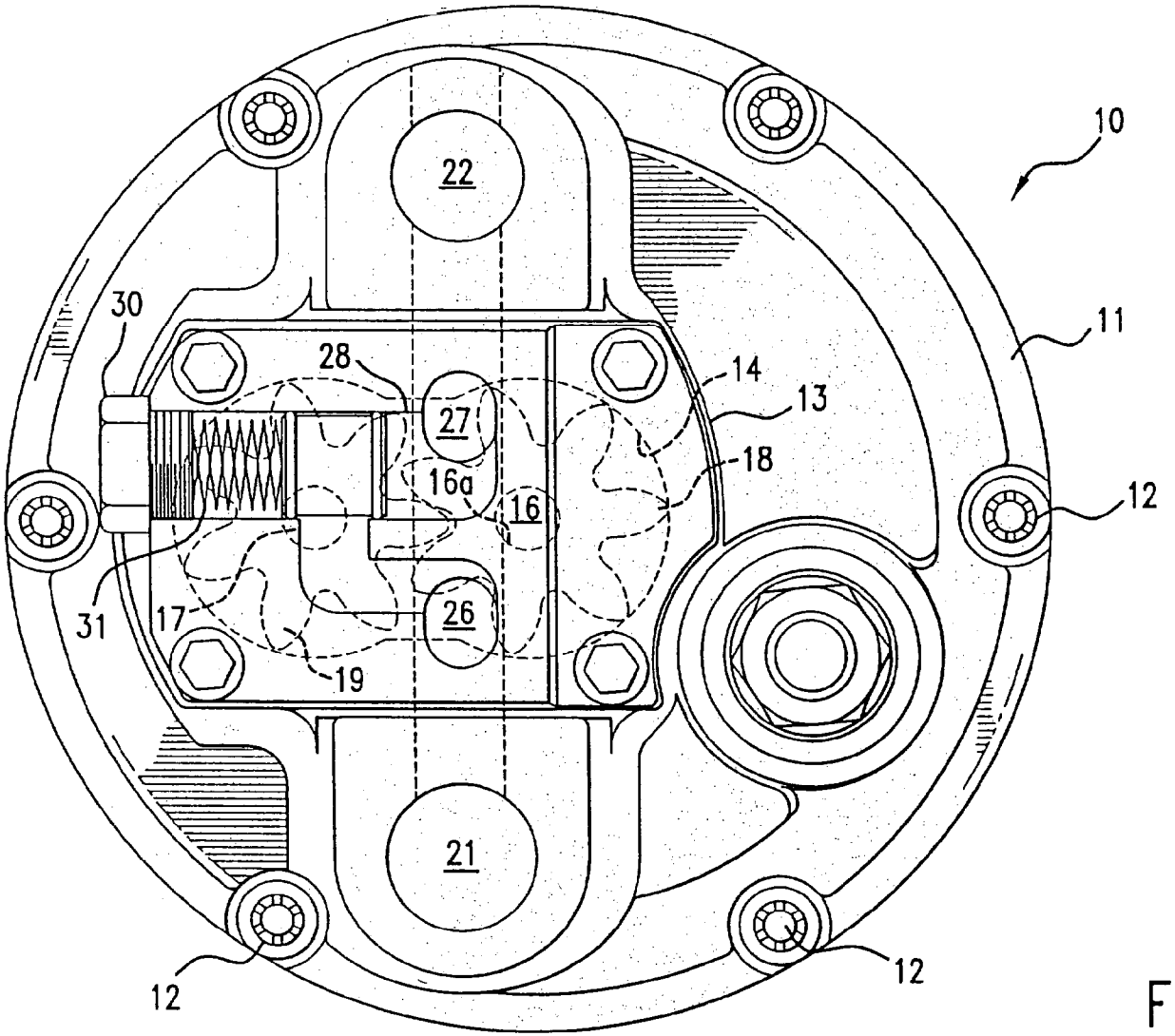
FIG. 1 is a plan view of the pump in an embodiment of the invention.
Figure 2:
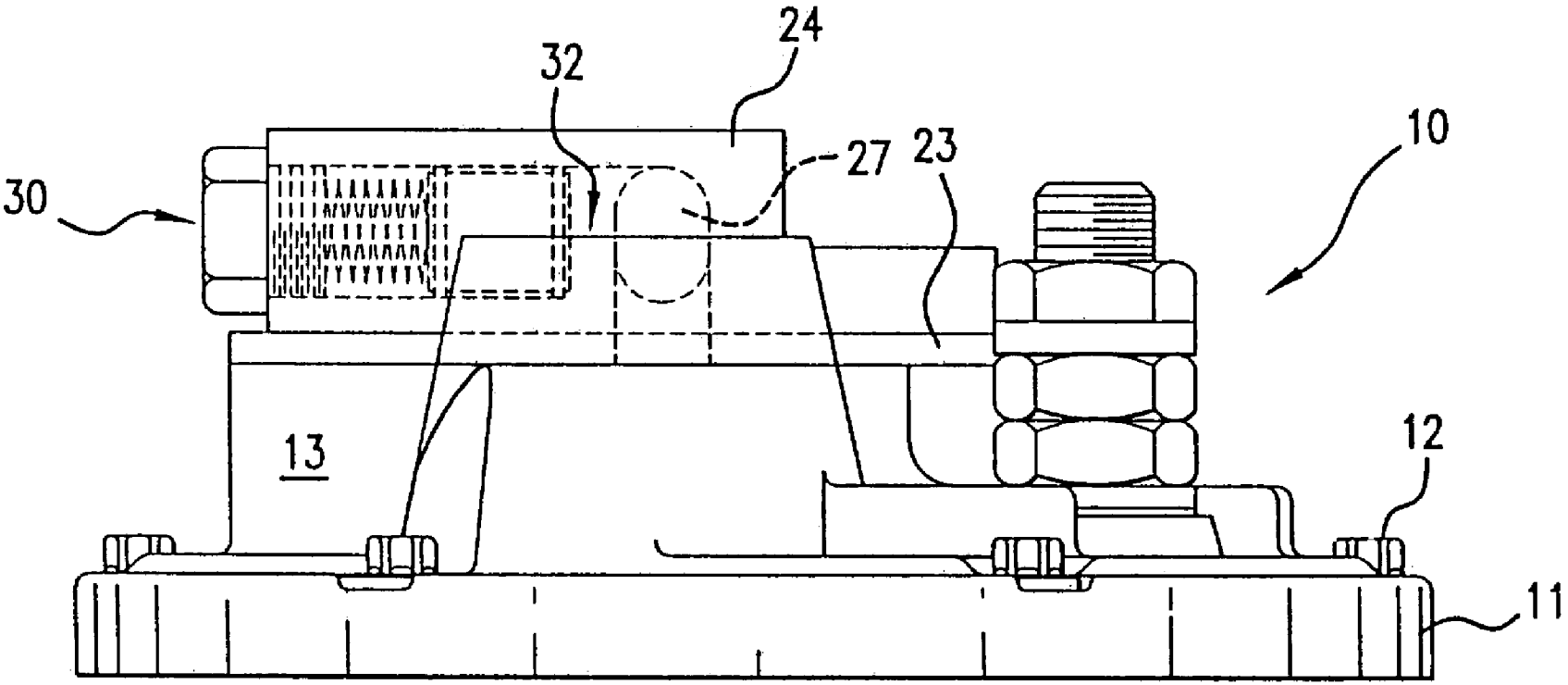
FIG. 2 is a side elevation of the pump shown in FIG. 1.

Referring to FIGS. 1 and 2, pump 10 of the present invention comprises base plate 11 which is adapted to be bolted to the back portion of a starter motor (not shown) by means of a plurality of a circumferentially positioned bolts 12. Integrally formed in base plate 11 is pump housing 13 having an elongated pump cavity 14 and central opening through which a motor or armature shaft 16 extends therein. Cavity 14 also includes idler shaft 17 mounted fixably to the other portion of the cavity. Positioned within cavity 14 are pump gears 18 and 19 which are driven by armature shaft 16.

Figure 3:
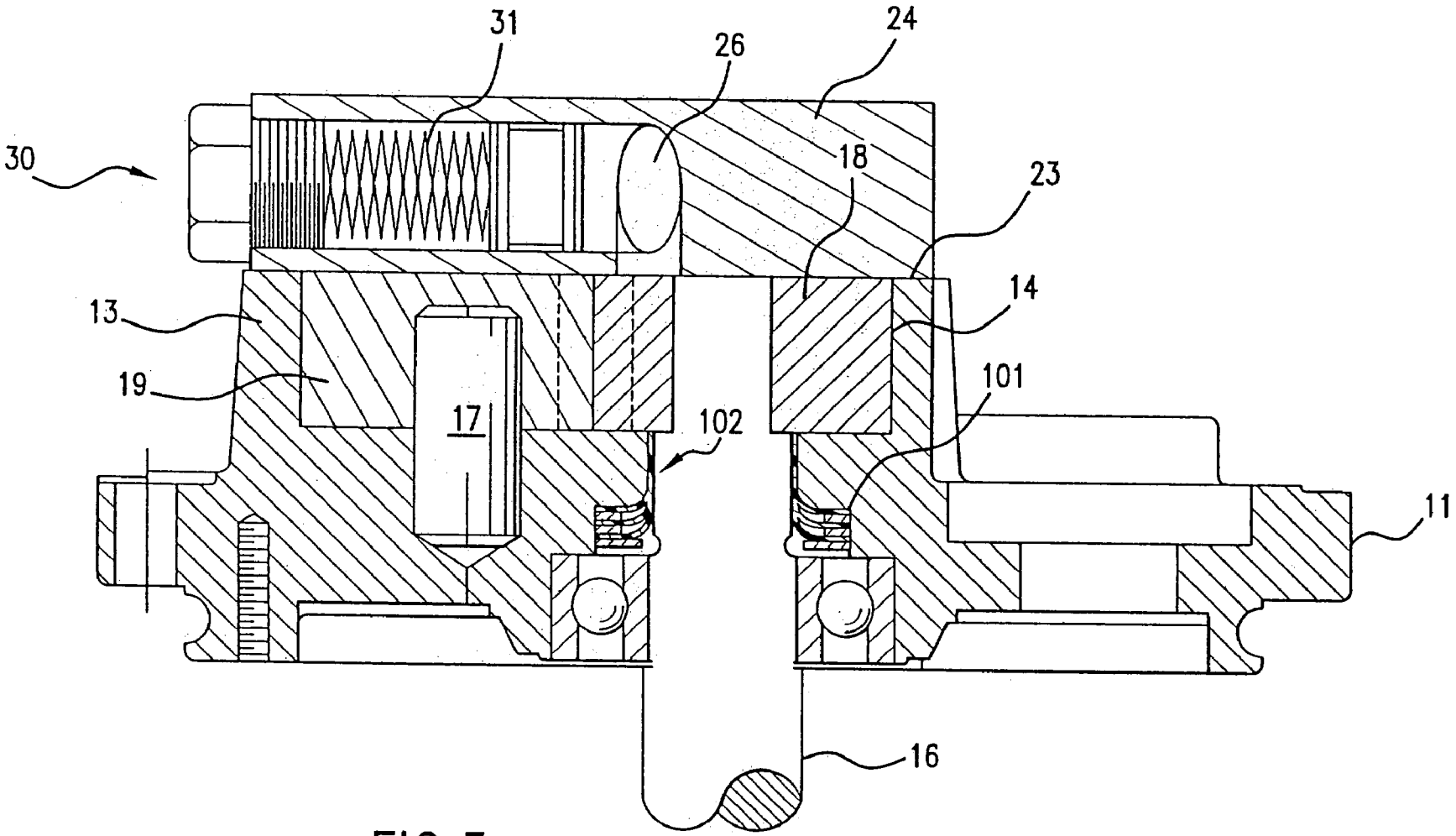
FIG. 3 is a sectional elevation of an embodiment of the invention.

Pump housing 13 also includes inlet port 21 and outlet port 22. These ports are connected to inlet and outlet lines (not shown). Sealingly mounted to the pump housing 13 is sealing plate 23 which seals pump cavity 14 from the outside and shaft seal 101 which seals pump cavity 14 from the motor cavity, as shown in FIG. 3.

Figure 4:
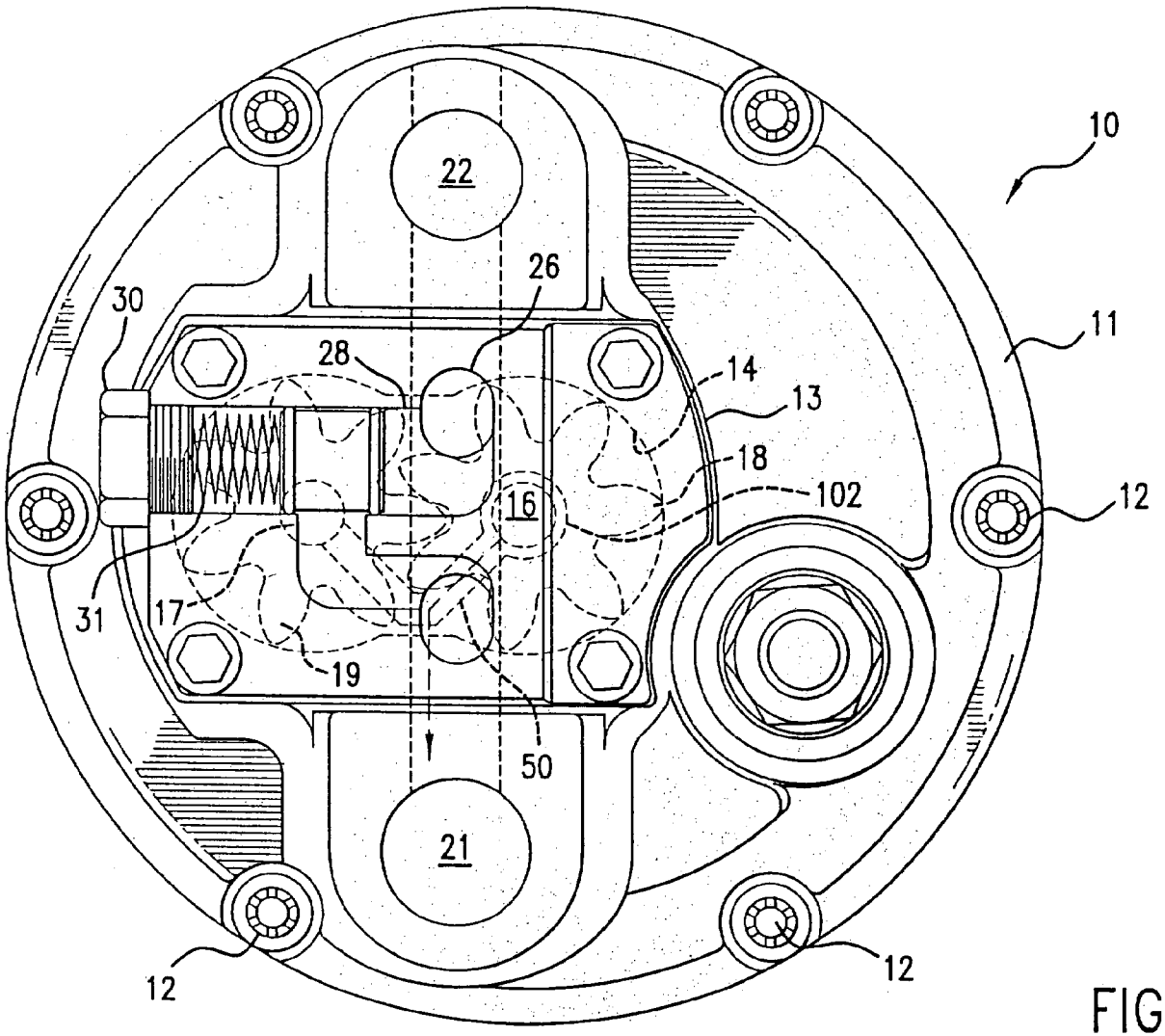
FIG. 4 provides a plan view diagram of a embodiment of the invention showing oil flow path and pressure relief.

Pump housing 13 also includes a means to reduce pressure to the seal 101. The pressure reducer includes, for example, a vent, channel, groove, bypass, hole, drilling or other passageway in the pump or pump housing. The pressure reducer is positioned in the pump between two pressure areas, or connected to a bore and inlet port, to decrease pressure in the area of the shaft seal. In one embodiment, the pressure reducer includes a vent 50 from the pump seal bore 102 to the pump inlet 21 which provides a passageway or otherwise connects to and is positioned within pump housing 13 on the side of inlet port 21, as shown in FIG. 4. In another embodiment, the vent 50 is a grooved channel connecting with armature shaft 16 or seal bore 102 of pump housing 13 and is positioned in the pump to relieve pressure from seal 101 to prevent damage to the pump and motor. In this way, vent 50 functions to minimize the oil pressure, or other fluid pressure, at the seal 101, as well as at seal bore 102, during all modes of operation. FIG. 4 also shows a diagram of an embodiment of the present invention of the oil flow path through channel 28 and pressure relief through vent 50 and out suction port 21. In one embodiment, vent 50 provides a self-adjusting restriction on increases to the oil pressure. In another embodiment, vent 50 comprises a valve operated manually, electronically or via self-regulation, for example. Vent 50 is also applicable to stand alone or supplemental pumps.

In an embodiment, sealing plate 23 includes housing 24. In another embodiment housing 24 also has a pair of bypass ports 26 and 27 which are juxtaposed for communication between inlet and outlet ports 21 and 22 respectively. A valve means, such as for example a selector valve 30 comprised of a plug spring 31, and plunger or valvehead, is positioned in channel 28 to provide selectable opening and closing of the channel. Valve 30 is preferably a mechanically or hydraulically operated valve that is opened to permit recirculation. Alternatively, an electromechanical solenoid valve which is normally biased in the open position can be used. When the valve 30 is open, oil recirculates to the inlet port 21. In systems where rotation of the gears is normal operation oil flows through channel 28 as the pump rotates during starter motor initiation of conventional crank mode. Valve 30 is shown having spring 31 which biases hydraulic valve means 30 closed. Oil pressure or electrical 32 such as a solenoid opens valve 30 to permit the recirculation of oil through channel 28. In an embodiment, vent 50 is useful to prevent any excess pressure in the pump seal bore 102 of a pump having restricted channel.

In an embodiment, the valve 30 will be closed when outlet port 22 is open to permit oil to be pumped therethrough. Outlet port 22 may include an oil line to the engine to provide prelubrication as known in the prior art or to a discharge receptacle, not shown, for changing the oil in the engine. A switch positioned in the engine compartment can be used to simultaneously activate the turning of the starter motor (without engaging the starter solenoid) so that the closed valve 30 permits the oil to be pumped out of the engine. Various other arrangements can be used to control valve 30 with oil or other fluid change and/or prelubrication flow control valves (not shown) positioned at the outlet port or line.

Figure 5:
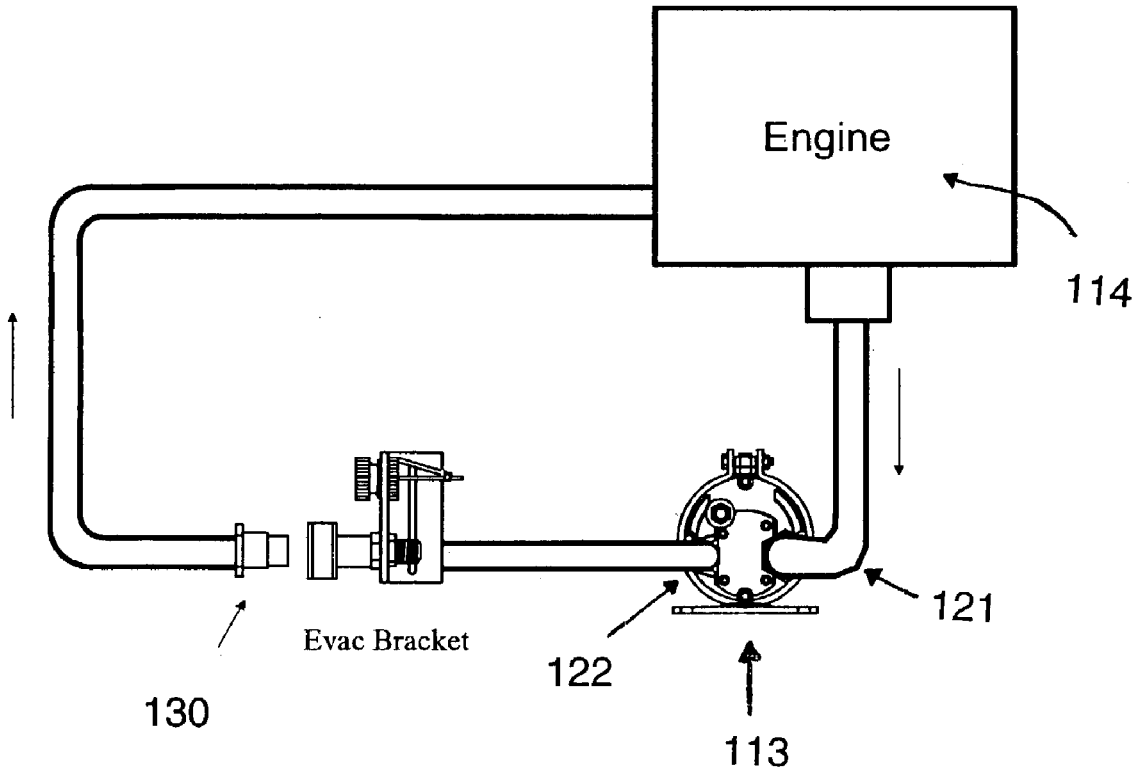
FIG. 5 provides a schematic diagram of an embodiment of a supplemental pump used to evacuate and/or fill a single reservoir.

In another embodiment, the pump is used as a supplemental pump in a pump assembly for evacuating other reservoirs including, for example, transmission, hydraulics or differential reservoirs. As shown in FIG. 5, a pump assembly is used as a supplemental pump for evacuating or filling a single reservoir. Supplemental pump housing 113 is connected for use with engine 114. Pump housing 113 includes an inlet port 121 and outlet port 122 connected to inlet and outlet lines. Sealingly mounted to pump 113 are a sealing plate and shaft seal which seal the pump cavity. Pump 113 also includes an internal pressure reducer which includes, for example, a vent, groove, channel, bypass, hole, drilling or other passageway in the pump or pump housing. In an embodiment, the pressure reducer provides a vent 50 from the pump seal bore to the pump inlet which is positioned within pump 113 on the side of the inlet port. The vent connects the bore to the inlet or suction port for decreasing pressure in the area of the seal. In another example, the pressure reducer is a channel connecting with armature shaft of the pump housing and is positioned in the pump to relieve fluid pressure at the seal and to the seal bore thereby preventing damage to the pump and motor. In an example, the lines have a quick disconnect 130 for evacuating or filling fluid.

Figure 6:
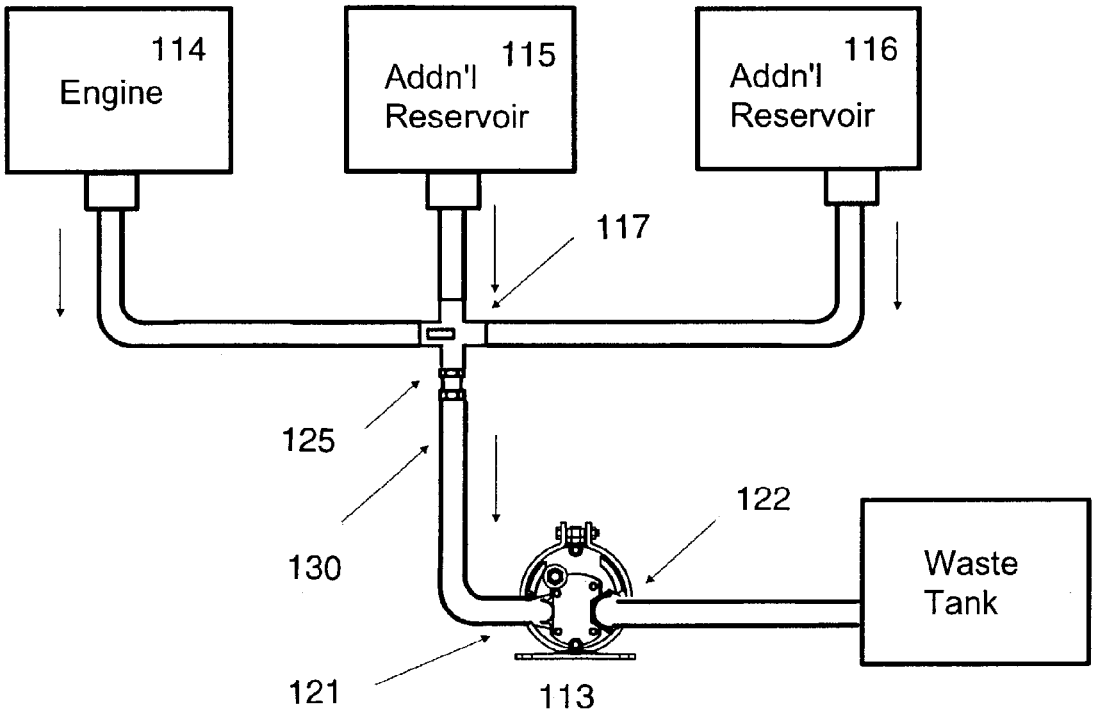
FIG. 6 provides a schematic diagram of an embodiment of a supplemental pump used to evacuate and/or fill multiple reservoirs.

In another embodiment, shown in FIG. 6, a supplemental pump 113 is used with engine 114 to evacuate or fill multiple reservoirs, including additional reservoirs 115 and 116. A multipositional control valve 117 is used to connect lines enroute to the supplemental pump 113, reservoirs, 115 and 116, and an evacuation port 125. Pump 113 includes a pressure reducer positioned in the pump on the inlet or suction port side 121 to draw pressure away from the pump seal. The pressure reducer includes, for example, a vent, groove, channel, bypass, hole, drilling or other passageway. In an embodiment, pressure reducer is positioned between a central opening in the pump housing through which a motor or armature shaft extends and bypass port. In an example, evacuation port 125 is connected to the lines using a quick disconnect 130. Alternatively, in an embodiment, multiple lines can be assembled into a cube assembly. In an example, the supplemental pump 113 is connected to a source or sources of new fluid to refill the reservoirs or the fluid cavities connected to them. In another example, the pump is a hand-held pump such as, for example, a hand-held pump used in-line with a flexible portable conduit or portable fluid transfer conduit (as in U.S. Pat. No. 6,216,732) used to transfer fluid.

While various embodiments of the invention have been shown and described in particularity, the invention may be otherwise embodied within the scope of the appended claims.

What is claimed is:

1. An improved pump assembly for use with a motor comprises:

a. a pump housing having a pump cavity;

b. a first and second gear positioned in said cavity for pumping fluid, said first gear being operably and sealably connected to a motor shaft for rotation said shaft being positioned through a seal bore, and said second gear rotatably mounted to a second shaft for geared rotation with said first gear;

c. fluid inlet and outlet ports in communication with said cavity and adapted for connection with a source of fluid and a discharge means, respectively;

d. a shaft seal which seals said pump cavity from said motor shaft; and e. an internal vent positioned between said shaft seal bore and said inlet port, wherein said vent connects said bore to said inlet port thereby decreasing the pressure in the area of said seal.

2. An improved pump assembly as set forth in claim 1 wherein said first gear is operably connected to a motor.

3. An improved pump assembly as set forth in claim 1 wherein said motor is a starter motor of a vehicle.

4. An improved pump assembly as set forth in claim 3 wherein an armature of said starter motor comprises said means for rotating said first gear.

5. An improved pump assembly comprising a pump housing having a pump cavity, a means positioned in said cavity for pumping fluid and fluid inlet and outlet ports in combination with said cavity, said pump assembly further including a valve positioned between said inlet and outlet ports, said valve being controllable to permit fluid pumped between the inlet and outlet ports to pass through said valve when said outlet port is flow restricted, said valve being normally closed to fluid pumped by said first and second gears to flow from said inlet port to said outlet port, during prelubrication or a fluid change, said valve is opened to permit the fluid to recirculate in response to a selective control input during operation of the pump when said prelubrication or fluid change is not selected.

6. An improved pump assembly as set forth in claim 5 wherein said valve is a hydraulic valve biased closed until a preselected pressure is established by a restriction in oil flow to the outlet port.

7. An improved pump assembly as set forth in claim 5 further including a vent positioned into said pump housing along said inlet port.

8. An improved pump assembly as set forth in claim 7 wherein said vent is connected to a motor shaft bore.

9. An improved pump assembly as set forth in claim 5 further including a pressure reducer in said pump assembly.

10. In a pump having a motor shaft positioned through a seal bore, a fluid inlet port and a fluid outlet port in communication with a pump cavity and adapted for connection with a source of fluid and a discharge outlet, a means for pumping fluid in said pump cavity, and a shaft seal which seals said pump cavity from said motor shaft, the improvement therein being a vent positioned between said bore and said inlet port, wherein said vent connects said bore to said inlet port thereby decreasing the pressure in the area of said seal.

11. A pump or pump assembly as set forth in claims 1, 7 or 10 wherein said vent is selected from one of the group comprising a groove, hole, drilling, channel, bypass and passage way.

12. A pump or pump assembly as set forth in claim 5 further comprising a pressure reducer positioned between two pressure areas in said pump assembly to decrease pressure in an area of a shaft seal.

13. A pump or pump assembly for use with an engine or machine, comprising:

a. a pump housing having a pump cavity;

b. a first and second gear positioned in said cavity for pumping fluid, said first gear being operably and sealably connected to a motor shaft for rotation said shaft being positioned through a seal bore, and said second gear rotatably mounted to a second shaft for geared rotation with said first gear;

c. fluid inlet and outlet ports in communication with said cavity and adapted for connection with a source of fluid and a discharge means, respectively;

d. a shaft seal which seals said pump cavity from said motor shaft; and e. an internal pressure reducer positioned between said shaft seal bore and said inlet port to decrease the pressure in an area of said seal, wherein said pump or pump assembly is a part of a system that is supplemental to said engine or machine.

14. A pump assembly as in claim 13, further comprising a valve positioned between said inlet and outlet ports, said valve being controllable to permit fluid pumped between the inlet and outlet ports to pass through said valve when said outlet port is flow restricted, said valve being normally closed to fluid pumped by said first and second gears to flow from said inlet port to said outlet port, during prelubrication or a fluid change, said valve is opened to permit the fluid to recirculate in response to a selective control input during operation of the pump when said prelubrication or fluid change is not selected.

15. A pump or pump assembly as set forth in claims 1, 5, 10, or 13 wherein said pump assembly is an engine prelubrication pump assembly.

16. A pump or pump assembly as set forth in claim 13, wherein said pump assembly is connected to at least one source of new fluid to refill at least one reservoir of fluid cavities connected to said at least one source.

17. A pump or pump assembly as set forth in claims 1, 5, 10, or 13, wherein said pump or pump assembly comprises a hand-held pump in-line with a portable conduit used to transfer fluid.

18. A pump or pump assembly as set forth in claims 1, 5, 10, or 13, wherein said pump or pump assembly is used to evacuate or fill at least one reservoir.

19. A pump or pump assembly as set forth in claim 16, wherein said at least one reservoir is selected from the group comprising a transmission, hydraulics, differential reservoir and a combination of said reservoirs.

20. A pump or pump assembly as set forth in claims 12 or 13 wherein said pressure reducer is selected from one of the group comprising a groove, hole, drilling, channel, bypass, and passage way.

* * * * *